US006726316B2

(12) United States Patent
Shimizu

(10) Patent No.: US 6,726,316 B2
(45) Date of Patent: Apr. 27, 2004

(54) INK JET RECORDING APPARATUS

(75) Inventor: Seiji Shimizu, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/277,720

(22) Filed: Oct. 23, 2002

(65) Prior Publication Data

US 2003/0076389 A1 Apr. 24, 2003

(30) Foreign Application Priority Data

Oct. 23, 2001 (JP) ..... 2001-324470
Nov. 2, 2001 (JP) ..... 2001-337892

(51) Int. Cl.[7] ..... B41J 2/175
(52) U.S. Cl. ..... 347/85; 347/86
(58) Field of Search ..... 347/85, 86, 84, 347/66, 49

(56) References Cited

U.S. PATENT DOCUMENTS 5,552,815 A * 9/1996 Shimoda ..... 347/85
5,971,529 A 10/1999 Pawlowski, Jr. et al.

FOREIGN PATENT DOCUMENTS

JP A 2000-218822 8/2000

* cited by examiner

*Primary Examiner*—Lamson D Nguyen
(74) *Attorney, Agent, or Firm*—Oliff & Berridge, PLC

(57) ABSTRACT

A housing that includes a container with ink inlets sideways disposed therein and a recording head part on the bottom of the container. The housing is brought near to a scanning carriage mounted on a main guide rail in a direction parallel to a surface of the recording head part provided with nozzles, so that the ink inlets abut with ink outlets disposed horizontally in a joint of the scanning carriage face-to-face. An engaging member, which is formed of wire and in an angular C shape in a plan view, is rotatably mounted to the housing by attaching ends thereof on both sides of the housing. The engaging member is fitted in a recessed engaged part on the top of the scanning carriage so that the housing and the scanning carriage are fixed.

20 Claims, 10 Drawing Sheets

INK JET RECORDING APPARATUS

BACKGROUND OF THE INVENTION

1. Field of Invention

The invention relates to an ink jet recording apparatus of a piezoelectric type and, more particularly, a recording head detachably mounted on a scanning carriage.

2. Description of Related Art

Ink jet recording apparatuses record on a recording medium, such as a sheet of paper, by ejecting droplets of ink thereon from the nozzles in a recording head based on input signals. In such an ink jet recording apparatus, ink is conveyed from an ink supply source, such as an ink tank, which is fixed external to a scanning carriage where the recording head is mounted, to the recording head via a supply tube.

For example, in U.S. Pat. No. 5,971,529, four tubes, each connected to an ink supply cartridge, are in fluid connection with a rubber septum for each of the four stalls in a carriage. A hollow needle, formed as part of each print cartridge, is inserted through the rubber septum upon pushing the print cartridge into its associated stall within the carriage so that a fluid communication path exists between a particular ink supply cartridge and a particular print cartridge for providing a supply of ink to the print cartridge. A plastic conduit leads from the needle to the ink chamber via the hole. Ink is provided to the carriage by tubes which connect to a plastic manifold. A septum elbow routes ink from the manifold to the septum and supports the septum. The septum is affixed to the elbow using a crimp cap.

According to the above structure, however, the ink path becomes long and complicated, and the cost of manufacturing increases. This path also requires an arrangement so as to increase the height of the print cartridge, thereby increasing the recording head unit, as a whole, in size.

In Japanese Laid-Open Patent Publication No. 2000-218822, a recording head is arranged in a carriage and a plurality of sub-tanks, corresponding to the respective colors of inks, are housed in the respective housing chambers of a recording head housing. The shaft of the carriage is inserted into the insert holes of the arms projected from the sub-tanks and, when levers are picked to revolve the sub-tanks, only the sub-tanks are raised to be perfectly separated from a recording head and, therefore, only the recording head can be replaced.

According to the above structure, the recording head is replaced after the sub-tanks are removed from the carriage.

What is needed is an improved ink jet recording apparatus where separation of a recording head from a scanning carriage is easy and the head is compact in size.

SUMMARY OF THE INVENTION

The invention provides an ink jet recording apparatus that facilitates the connection and disconnection of a recording head with respect to a scanning carriage and enables a compact size of the recording head and the scanning carriage.

In one exemplary aspect of the invention, the ink jet recording apparatus may include a scanning carriage that is movable in a direction perpendicular to a feeding direction of a recording medium; a recording head with nozzles that is detachably mounted to the scanning carriage; an ink supply source that is provided outside the scanning carriage and supplies ink to the recording head via a supply tube; a joint member that is provided in the scanning carriage and connected to the supply tube of the ink supply source; an ink inlet that is provided in the recording head; an ink outlet that is provided in the joint member; and an engaging device that fixes the recording head to the scanning carriage. The recording head is detachable from the scanning carriage in a direction perpendicular to a direction in which ink is ejected from the nozzles with respect to the recording medium, and the ink inlet is detachable from the ink outlet along the direction where the recording head is detachable from the scanning carriage.

As the ink inlet and the ink outlet are in contact with each other along the direction where the recording head is detachable from the scanning carriage, there is no need to increase the height dimension of the recording head (the height dimension along the direction where ink is ejected from the nozzles). As a result, the recording head can be designed compactly in size.

In another exemplary aspect of the invention, the ink jet recording head apparatus may include a scanning carriage that is movable in a direction perpendicular to a feeding direction of a recording medium; a recording head with nozzles that is detachably mounted to the scanning carriage; an ink supply source that is provided outside the scanning carriage and supplies ink to the recording head via a supply tube; a flat cable that transmits a drive signal to the recording head from outside of the scanning carriage; a joint member that is provided in the scanning carriage and connected to the supply tube of the ink supply source; an ink inlet that is provided in the recording head; an ink outlet that is provided to the joint member; a control circuit board that is provided to the recording head; and a connector that is provided in the recording head and detachably connected to the flat cable when the scanning carriage and the recording head are connected.

The flat cable can be removed at the connector provided in the recording head when the scanning carriage and the recording head are connected. Therefore, the flat cable can be readily connected and disconnected during a maintenance operation such as a replacement of the recording head as compared with a conventional flat cable.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

Figure 1:
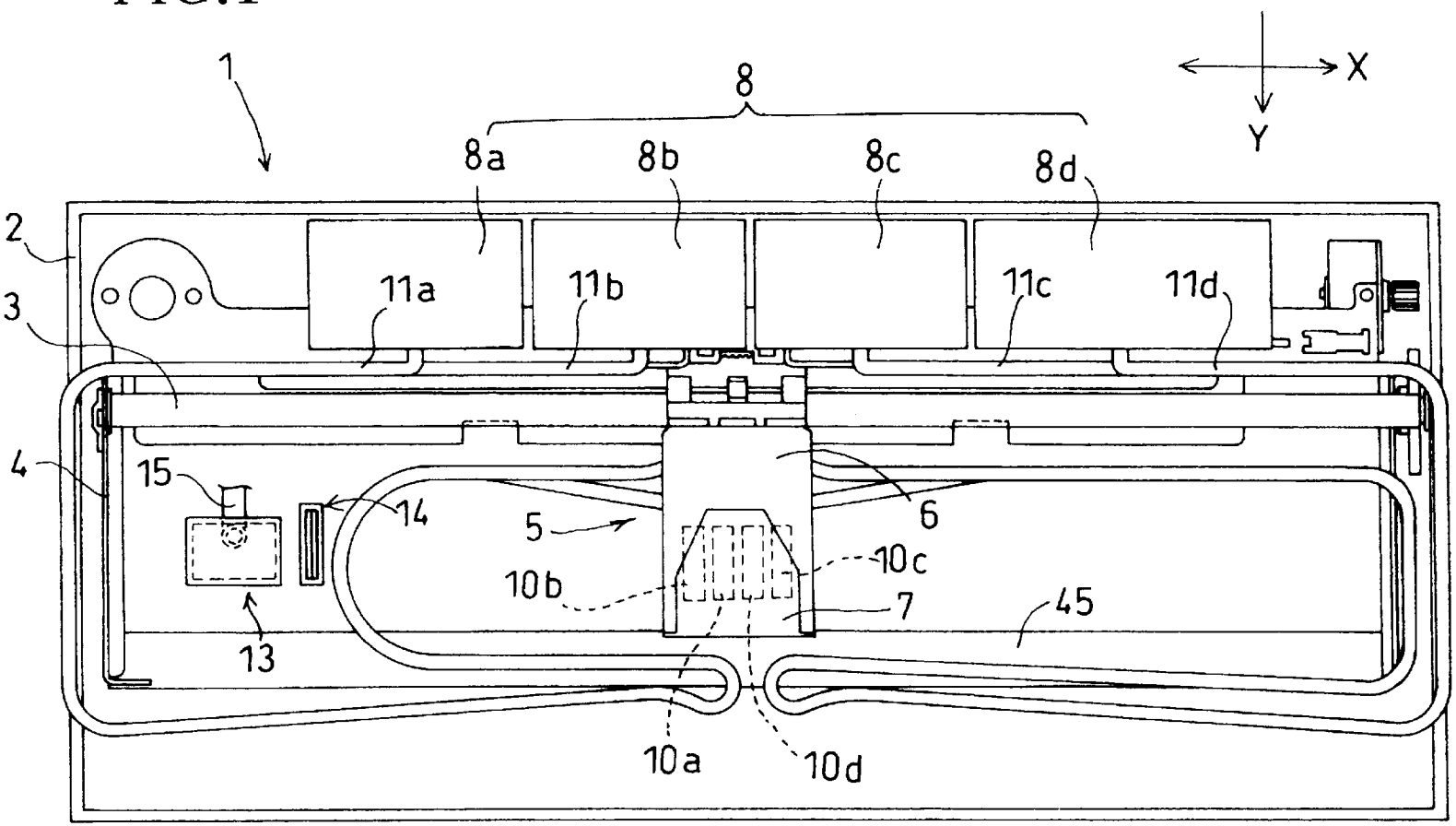
FIG. 1 is a plan view of an ink jet recording apparatus according to an embodiment of the invention.
Figure 2:
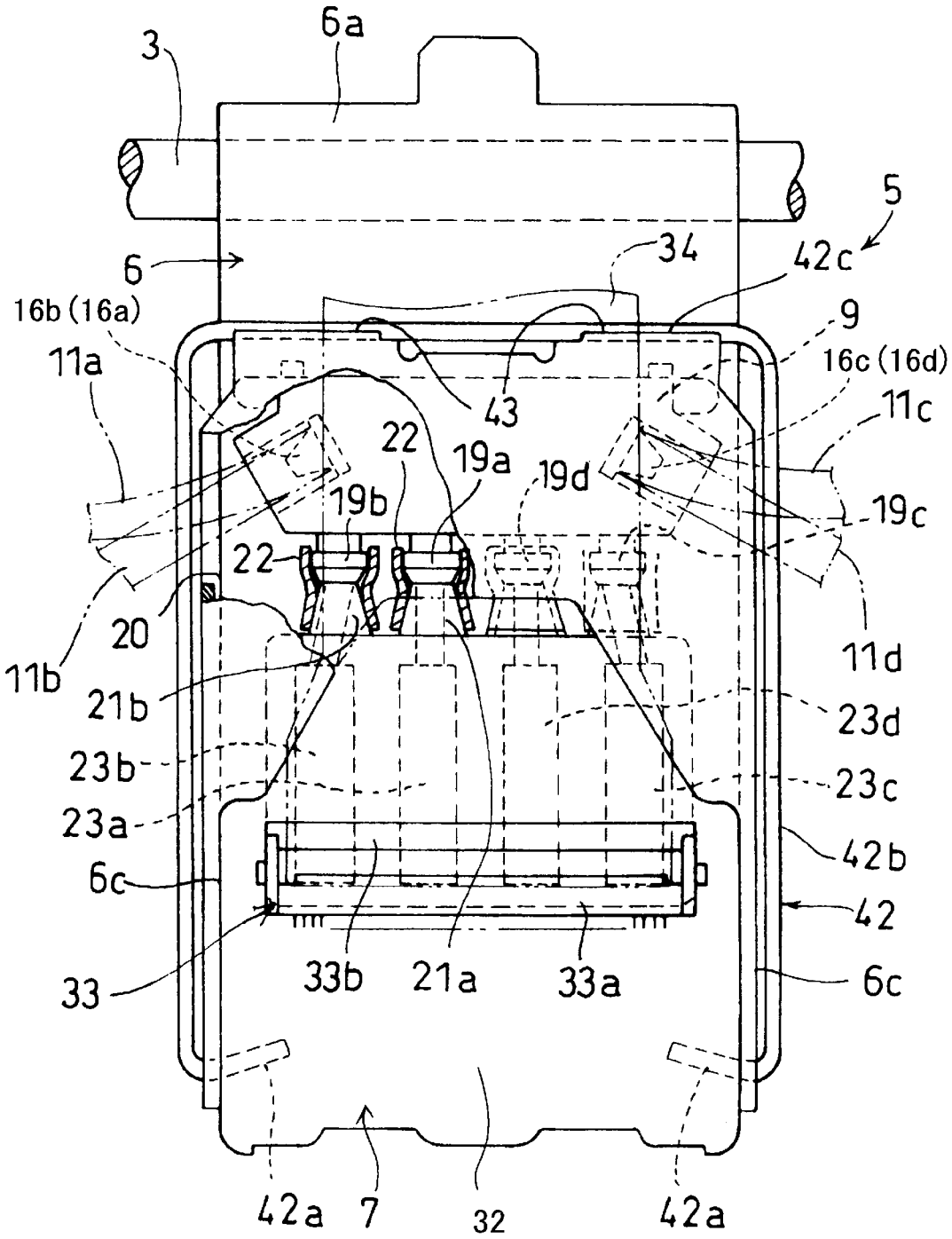
FIG. 2 is a plan view of a recording head unit.
Figure 3:
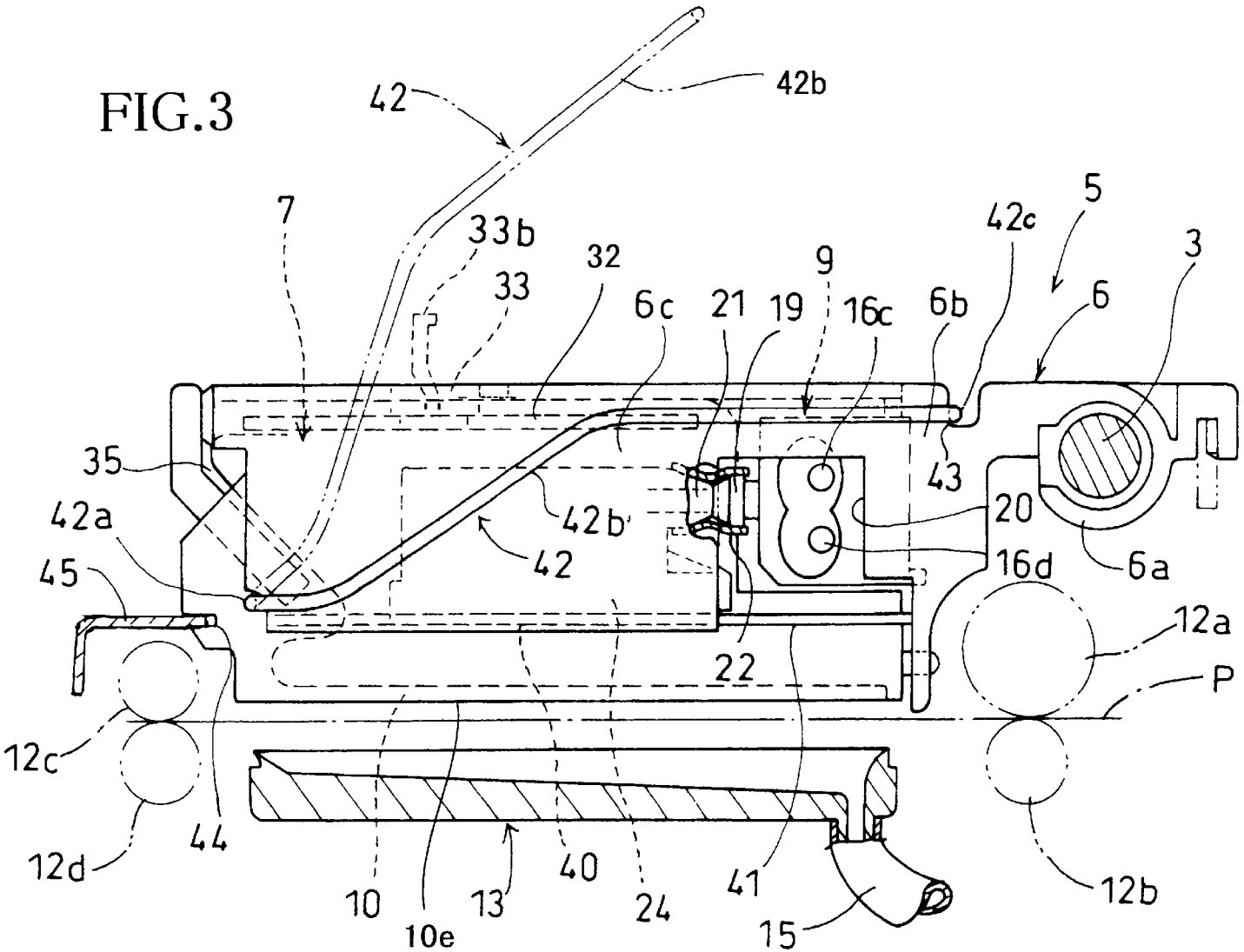
FIG. 3 is a side elevational view of the recording head unit.
Figure 4:
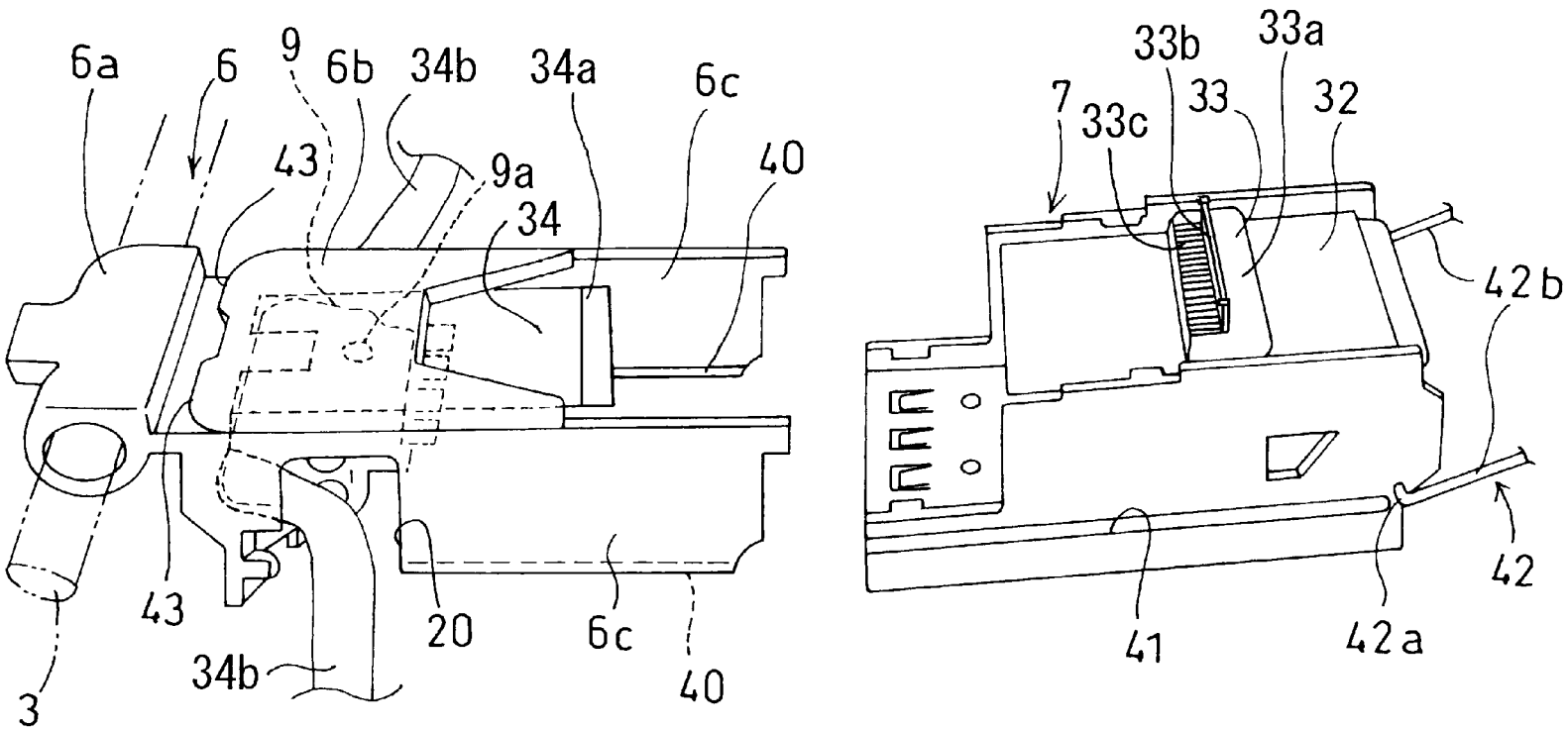
FIG. 4 is a perspective view of the recording head unit when a housing is removed from a scanning carriage.

A preferred embodiment of the invention will be described in detail with reference to the accompanying drawings. FIG. 1 is a diagrammatic plan view of an ink jet recording apparatus of the invention. FIG. 2 is an enlarged plan view of an essential part of a recording head unit. FIG. 3 is a transverse cross-sectional view of the recording head unit. FIG. 4 is a perspective view of the recording head unit when a housing is removed from a scanning carriage.

Referring to FIG. 1, essential parts of an ink jet recording apparatus 1 will be described. A main guide rail 3 and a sub guide rail 45, which are long in the right and left direction (x direction shown in FIG. 1, hereinafter referred to as a main scanning direction), are fixed in a frame 4 in a body case 2 of the ink jet recording apparatus 1. A recording head unit 5 is movably attached to the main guide rail 3 and the sub guide rail 45, so that it can be moved back and forth in the main scanning direction within a specified range by a timing belt and a drive motor, which are not shown.

The recording head unit 5 includes a scanning carriage 6 and a housing 7 having a recording head part 10 at the bottom surface. The housing 7, as a recording head, is detachably connected to the scanning carriage 6 in a substantially horizontal direction.

In FIG. 1, ink cartridges 8*a*, 8*b*, 8*c*, 8*d*, individually storing four color inks (magenta, yellow, cyan, and black) as ink supply sources, are arranged in a horizontal row under a sheet which is fed. The ink cartridges 8*a*, 8*b*, 8*c*, and 8*d* are connected to ink supply tubes 11*a*, 11*b*, 11*c*, and 1*d* at their proximal ends. The ink supply tubes 11*a*, 11*b*, 11*c*, and 11*d* are formed of synthetic resin having flexibility and connected to a joint 9 designed for supplying ink, which is fixed in the scanning carriage 6. Ink is supplied from the joint 9 via ink paths in the housing 7 to the recording head part 10.

In the embodiment, the recording head part 10 includes four recording heads 10*a*, 10*b*, 10*c*, and 10*d* for four colors (magenta, yellow, cyan, and black), which are disposed parallel to each other for color image formation. Each ink is ejected downwardly from nozzles 10*e* on the lower surface of the recording head part 10, to be adhered to the surface of a sheet P (shown in FIG. 3). The nozzles 10*e* are disposed parallel to the sheet P. The sheet P is fed in a Y direction (hereinafter referred to as a sub scanning direction) in FIGS. 1 and 3. In order to feed the sheet P, a feeding device including a pair of conveying rollers 12*a*, 12*b* upstream of a conveying direction, and a pair of conveying rollers 12*c* and 12*d* downstream thereof, as shown in FIG. 3, is provided below the recording head unit 5.

At the left end part of the body case 2 in FIG. 1 (end part of moving range of the scanning carriage 6), a suction cap 13 for suction purge and a wiper blade 14 for wiping the surface of each recording head 10*a*–10*d* are disposed so as to face the recording head part 10. During a suction purge operation, the suction cap 13 moves to cover the front surface (facing downward) of each recording head 10*a*–10*d*. A suction pipe 15 connected to the suction cap 13 is connected to a waste zone of a waste tank, which is provided in, for example, one of the ink cartridges 8*a* to 8*d*, via a suction pump which is not shown. Waste ink sucked during the suction purge operation is ejected to the waste zone. As a method to restore the recording heads 10*a*–10*d*, application of high pressure to ink at the ink cartridge side is used as well as the suction described above.

The structure of the recording head unit 5 will be described with reference to FIGS. 2 to 8. As shown in FIGS. 2, 3, and 4, the scanning carriage 6 is formed of synthetic resin and made up of a proximal part 6*a* engaged with the main guide rail 3, a joint storing part 6*b* with a space opened at the front of the body case 2 (opposite to the placement of the ink cartridges 8), and a pair of supporting frames 6*c* extending further forward from the joint storing part 6*b*, which are molded in one piece.

Figure 6A:
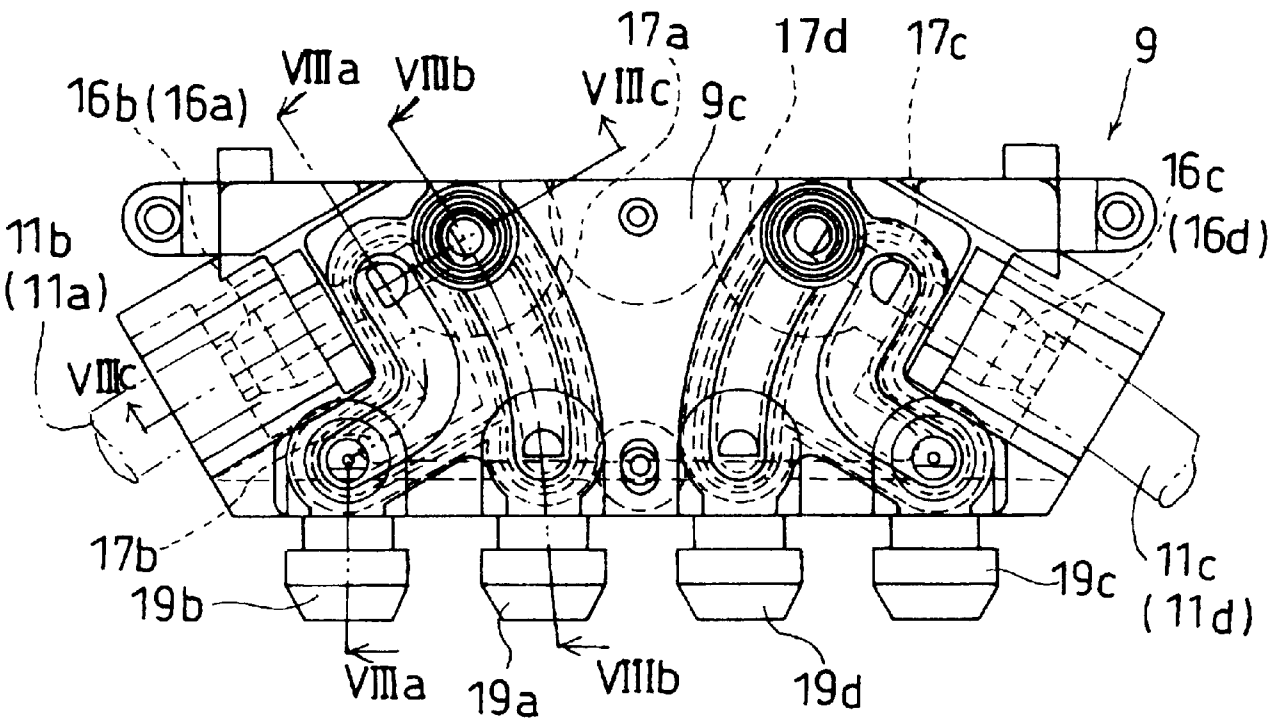
FIG. 6A is a plan view of a joint.
Figure 6B:
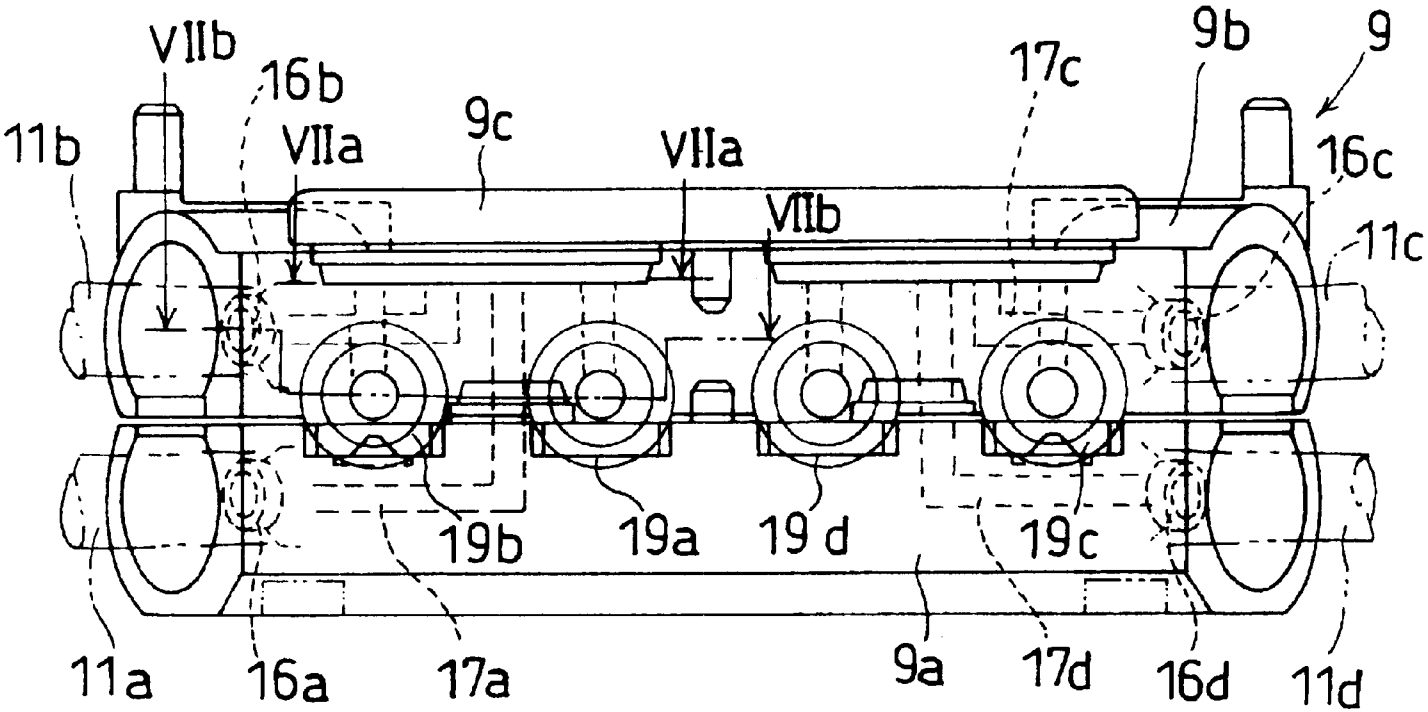
FIG. 6B is a front view of the joint.
Figure 7A:
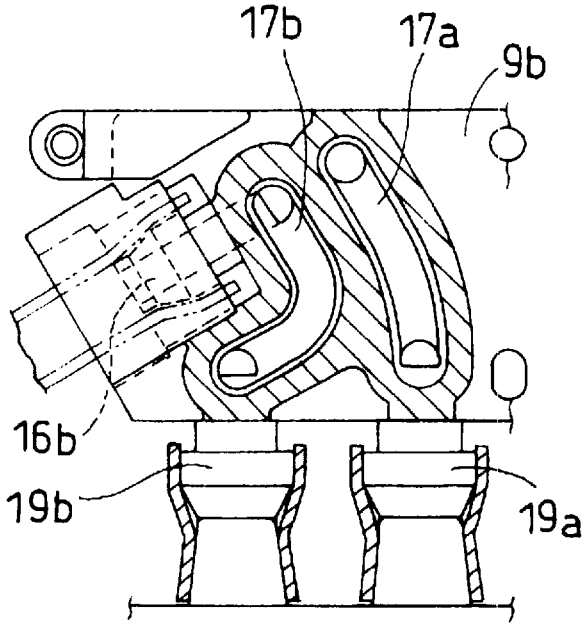
FIG. 7A is a cross sectional view taken along line VIIa—VIIa of FIG. 6B.
Figure 7B:
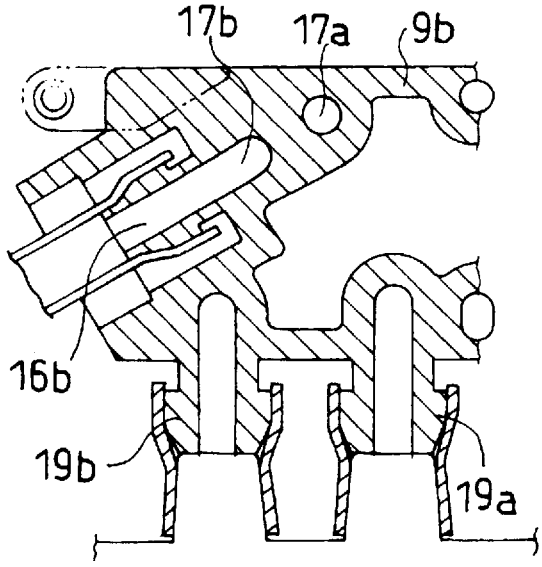
FIG. 7B is a cross sectional view taken along line VIIb—VIIb of FIG. 6B.
Figure 8A:
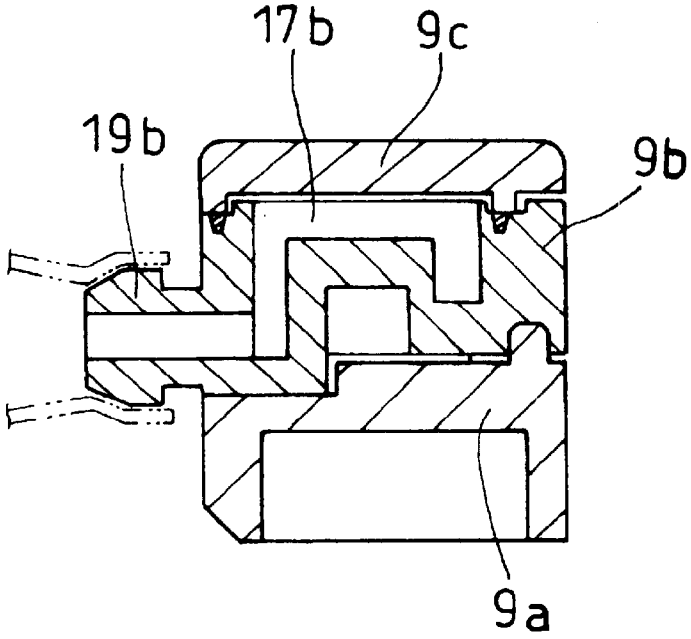
FIG. 8A is a cross sectional view taken along line VIIIa—VIIIa of FIG. 6A.
Figure 8B:
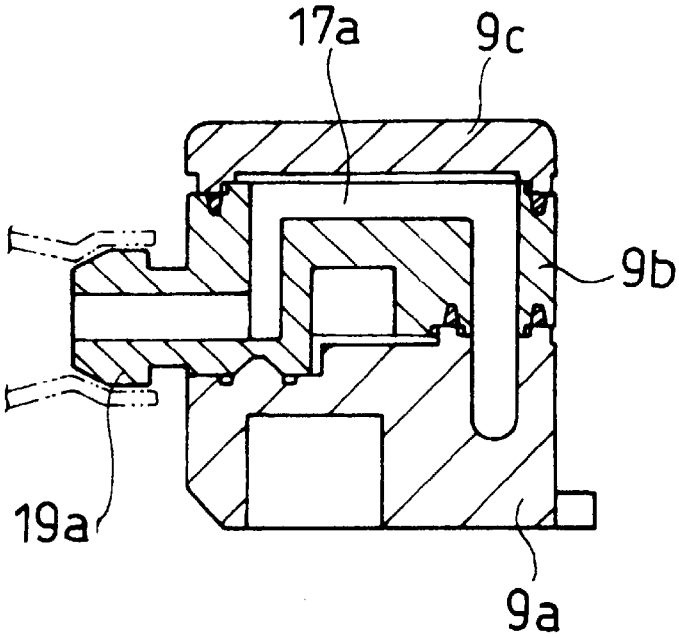
FIG. 8B is a cross sectional view taken along line VIIIb—VIIIb of FIG. 6A.
Figure 8C:
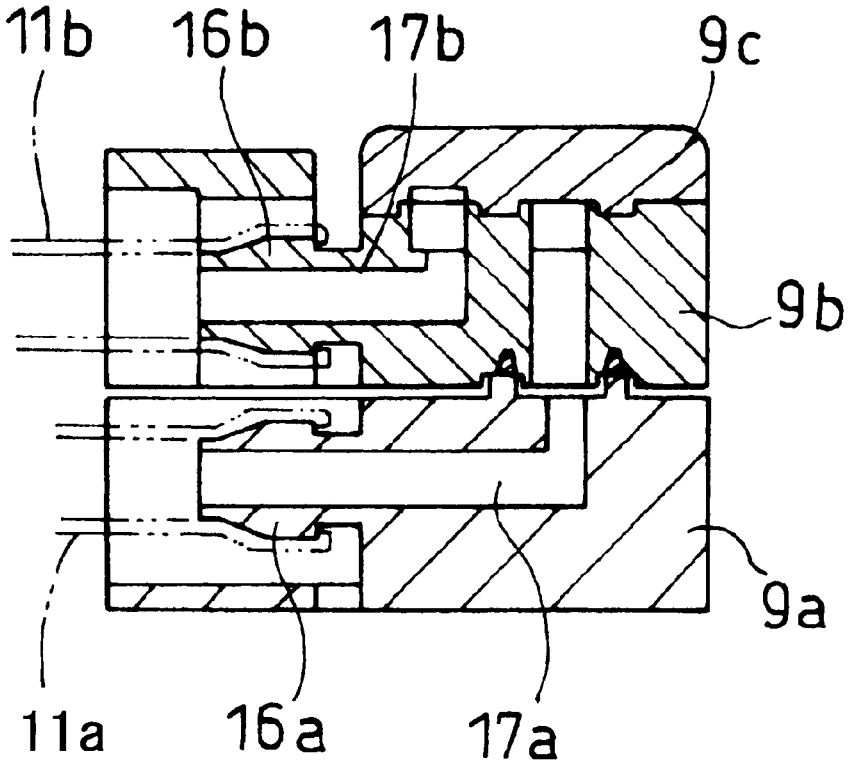
FIG. 8C is a cross sectional view taken along line VIIIc—VIIIc of FIG. 6A.

The joint 9 formed of synthetic resin, which is to be fixed inside the joint storing part 6*b*, is an airtight rectangular box, which is long from side to side as shown in FIGS. 6 to 8. The joint 9 includes a lower case 9*a*, an upper case 9*b*, and a lid 9*c* covering the top surface of the upper case 9*b*. As shown in FIG. 6B, connection ports 16*a*, 16*b*, 16*c*, and 16*d* are provided in openings at both ends of the lower case 9*a* and the upper case 9*b*. The connection ports 16*a*, 16*b*, 16*c*, and 16*d* are fitted in the ink supply tubes 11*a*, 11*b*, 11*c*, and 11*d* respectively, which are connected to the ink cartridge 8*a*, 8*b*, 8*c*, and 8*d*. In this case, as shown in FIGS. 3 and 4, the joint storing part 6*b* is formed with recesses 20 on both sides. Therefore, the ink supply tubes 11*a*, 11*b*, 11*c*, and 1 Id pass through the recesses 20 so that they can be connected to the connection ports 16*a*, 16*b*, 16*c*, and 16*d* in a substantially horizontal state.

An ink path 17*a* (FIGS. 6A, 7B, 8B, and 8C) connected in fluid communication to the connection port 16*a* is formed astride the lower case 9*a* and the upper case 9*b*. The ink path 17*a* is brought into fluid communication with an ink outlet 19*a*, which is in the second place from the left of the joint 9, as shown in FIGS. 6A and 6B. On the other hand, an ink path 17*b* (FIGS. 6A, 7A, 7B, 8A, and 8C) connected in fluid communication to the connection port 16*b* is formed in the upper case 9*b* only. The ink path 17*b* is brought into fluid communication with an ink outlet 19*b*, which is in the furthest left position of the joint 9, as shown in FIGS. 6A and 6B. Similarly, an ink path 17*c* connected in communication to the connection port 16*c* is formed in the upper case 9*b* only and brought into fluid communication with an ink outlet 19*c*, which is in the furthest right position (the fourth position from the left) of the joint 9. An ink path 17*d* connected in communication to the connection port 16*d* is formed astride the lower case 9*a* and the upper case 9*b* and brought into fluid communication with an ink outlet 19*d*, which is in the third position from the left of the joint 9. Each of ink outlets 19*a*–19*d* projects from the front surface of the joint 9 substantially horizontally.

On the other hand, the housing 7 formed of synthetic resin contains a box-shaped container 24, which is fixed therein. The container 24 is formed with air traps 23*a*, 23*b*, 23*c*, and 23*d* in which inks corresponding to the record heads 10*a*, 10*b*, 10*c*, and 10*d* are collected and air bubbles are trapped. (Refer to FIGS. 2 and 5.)

Figure 5:
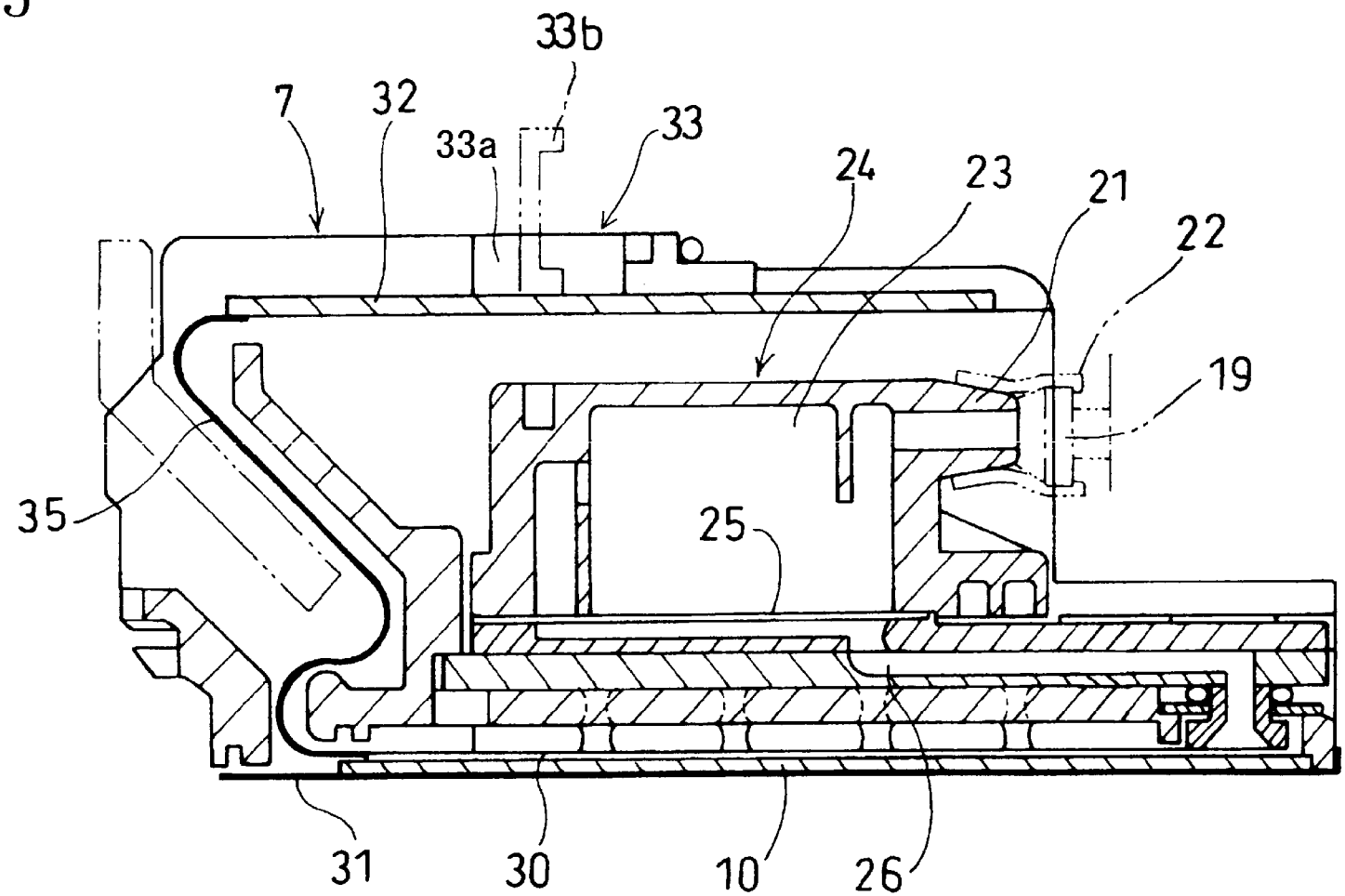
FIG. 5 is a sectional side elevation view of the housing.

As shown in FIG. 5, the housing 7 is formed with ink inlets 21*a*, 21*b*, 21*c*, and 21*d* (generically 21) at the rear end, which faces to the scanning carriage 6. The ink inlets 21*a*, 21*b*, 21*c*, and 21*d* project rearward from the air traps 23*a*, 23*b*, 23*c*, and 23*d* (generically 23) substantially horizontally at a height so as to face the ink outlets 19*a*, 19*b*, 19*c*, and 19*d* (generically 19), respectively. The ink inlets 21*a* to 21*d* and the ink outlets 19*a* to 19*d* are connected so that the ink inlets 21*a* to 21*d* are hermetically sealed with tubular seal rings 22 fitted over the ink outlets 19*a* to 19*d*. The seal rings 22 are preferably formed of a resilient material such as silicone rubber, urethane rubber, nitrile-butadien rubber (NBR), isoprene rubber, butylene rubber, and fluorine rubber.

The recording head part 10 with a known structure is fixed on the lower surface of the container 24. On the lower surface of the recording head part 10, the nozzles 10*e* through which ink drops are ejected are arranged in rows. Ink supplied from a passage 26 via a filter 25 in each air trap 23 is, for example, delivered in an ink chamber for each nozzle, and ejected from each nozzle by an actuator 30 formed of a piezoelectric element, like a conventional structure. The lower surface of the housing 7 except for nozzles 10*e* arranged in rows is covered by a cover plate 31, to face a sheet P (as shown in FIGS. 3 and 5).

A printed circuit board 32, as an example of a control circuit board, is fixed on the upper surface of the housing 7 as shown in FIGS. 2, 3, and 4. On the upper surface of the printed circuit board 32, a rectangular connector 33 is fixed in substantially parallel with the main guide rail 3. The connector 33 has a lid 33*b* that pivots on a connector base 33*a*, and a plurality of contact points 33*c* are arranged on the connector base 33*a* with a fixed pitch (0.5-mm pitch in this embodiment) in a longitudinal direction thereof. A flexible flat cable 34 is placed on the connector base 33*a* at one end in such a manner that terminals 34*a* thereof are aligned with the contact points 33*c* on the connector base 33*a*. When the lid 33*b* is closed with this condition, the terminals 34*a* of the flat cable 34 and the contact points 33*c* of the connector base 33*a* are electrically continuous. The flat cable 34 is fixed partly between the joint storing part 6*b* of the scanning carriage 6 and the joint 9 by a screw 9*a* and bifurcated into two cables 34*b*. The two cables 34*b* come out of the recesses 20 on both sides of the joint storing part 6*b*, and are connected to an external device such as a computer (not shown) or a controller in the body case 2.

A flat cable 35 is soldered on the lower surface of the printed circuit board 32 at one end. The flat cable 35 is, at the other end, fixed and electrically connected to the actuator 30 in the recording head part 10 outside the container 24 and on a side opposite to that where the ink outlet 19 is disposed.

In a normal condition where the flat cable 34 is connected to the connector 33, a command to form an image or a drive signal for image data is transmitted from an external device such as a computer (not shown) or the controller (not shown) in the body case 2 to the printed circuit board 32 via the flat cable 34, and the actuator 30 is driven.

When the lid 33*b* is opened upward, the contact points 33*c* of the connector base 33*a* and the corresponding terminals of the flat cable 34 are easily disconnected and the housing 7 is also easily removed from the scanning carriage 6 as described later. Therefore, maintenance of the housing 7 is very simple.

The structure to remove the housing 7 from the scanning carriage 6 and fix the housing 7 to the scanning carriage 6 will be described. FIGS. 2, 3, and 4 show one embodiment of such a structure. Guide rails 40 are provided on lower edges of inner sides of the supporting frames 6*c* in the scanning carriage 6. Recessed guide grooves 41, which are to be engaged with the corresponding guide rails 40, are provided on both outer sides of the housing 7. The guide rails 40 and the guide grooves 41 serve to bring the recording head part 10 near to the joint 9 in a direction substantially parallel to the nozzles 10*e* of the recording head part 10. The housing 7 may include protruding guide rails and the supporting frames 6*c* of the scanning carriage 6 may be formed with recessed grooves.

An engaging member 42 is formed of metal wire which is bent in an angular C shape in a plan view, and has legs 42*b* and ends 42*a* bent inward. The engaging member 42 is rotatably mounted to the housing 7 by attaching the ends 42*a* to the front part (which is far from the proximal part 6*a*) on both sides of the housing 7.

A recessed engaged part 43 is formed between the proximal part 6*a* and the joint storing part 6*b* on the upper side of the scanning carriage 6, so that an engaging part 42*c* connecting the legs 42*b* of the engaging member 42 is fitted therein.

According to the above structure, when maintenance, for example, replacement of the recording head part 10 or the container 24 in the housing 7, is performed, the flat cable 34 is removed from the connector 33, the engaging part 42*c* of the engaging member 42 is unlatched from the engaged part 43 of the scanning carriage 6, and the housing 7 is pulled out horizontally from the scanning carriage 6. After maintenance is performed, the housing 7, which is separated from the scanning carriage 6 mounted to the main guide rail 3 as shown in FIG. 4, is inserted substantially horizontally between the supporting frames 6*c* with the recording head part 10 facedown. In other words, the housing 7 is inserted into the scanning carriage 6 so as to face the ink inlets 21*a*–21*d* at the rear of the housing 7 with the ink outlets 19*a*–19*d* at the front of the scanning carriage 6. At this time, the guide grooves 41 on both sides of the housing 7 are guided by the guide rails 40 on the inner sides of the supporting frames 6*c*, all the ink inlets 21*a* to 21*d* are brought in abutment with the corresponding ink outlets 19*a* to 19*d* face-to-face while being fitted into the seal rings 22 covering the ink outlets 19*a* to 19*d*. This insertion allows fluid communication between the ink inlets 21*a* to 21*d* and the ink outlets 19*a* to 19*d*. With this condition, the engaging member 42 is rotated in such a manner that the legs 42*b* surround the supporting frames 6*c* of the scanning carriage 6 from outside, and the engaging part 42*c* is fixed at the recessed engaged part 43 on the top surface of the scanning carriage 6 through the use of the elasticity of the engaging member 42. This prevents the housing 7 from becoming disconnected from the scanning carriage 6, and enables tight connection between the ink inlets 21*a* to 21*d* and the ink outlets 19*a* to 19*d*, which reliably prevents leakage of ink therebetween.

After engagement between the engaging member 42 and the engaged part 43, the terminals of the flat cable 34 are aligned with corresponding contact points 33*c* on the connector base 33*a*. When the lid 33*b* is closed, electric connection is established. With the flat cable 34 and the connector 33 disposed on the upper sides of the scanning carriage 6 and the housing 7 (on the opposite side of the nozzles 10*e* of the recording head part 10), connection and disconnection of the flat cable 34 can be easily done in a wide workspace. In addition, there is no need to provide a supporting member for the connector 33 because the connector 33 is supported on the housing 7. This also contributes to a compact design of the recording head unit 5.

To make sure of the engagement between the scanning carriage 6 and the head holder 7, the angular C-shaped engaging member 42 may be attached to the scanning carriage 6 so as to be movable on the ends 42*a* and the engaged member 43 may be formed in the head holder 7. In addition, the engaging member 42 may be in the form of a hook lever instead of a wire.

The sub guide rail 45 (FIG. 3) is fitted in a guide groove 44 at the front of the housing 7 and fixed to the frame 4 of the body case 2. The recording head unit 5 is supported by the main guide rail 3 and the sub guide rail 45, and is movable in the main scanning direction while keeping a clearance between a surface provided with the nozzles 10*e* of the recording head part 10 placed on the lower surface of the housing 7 and a feeding path of a sheet P constant. With the constant clearance, the image formation quality can be maintained.

In this invention, the housing 7 is removable from the scanning carriage 6 along a direction perpendicular to a direction in which ink is ejected on the sheet P from the nozzles 10*e* of the recording head part 10 (in other words, in a direction substantially parallel to the surface provided with the nozzle 10*e*). In addition, the ink inlets 21 in the housing 7 are separable from the corresponding ink outlets 19 in the joint 9 along the direction of which the housing 7 is separated from the scanning carriage 6. Therefore, the distance of the ink inlets 21 and the ink outlets 19 from the surface provided with the nozzles 10*e* (along the direction of which ink is ejected from the nozzles 10*e*) can be shortened and the ink paths in the container 24 can be lengthened in a lateral direction (in the direction substantially parallel to the surface provided with the nozzles 10*e*). Consequently, the container 24 can be made compact because there is no need to increase the height of the container 24.

As the connector 33 is disposed on the opposite side of the surface provided with the nozzles 10*e*, the flat cable 34 can be easily separated from the connector 33 during maintenance without having to bring hands near to the surface provided with the nozzles 10*e*.

The supporting frames 6*c* of the scanning carriage 6 in order to guide and support the housing 7 are formed long sideways, so that there is no need to increase the height dimension. As a result, the housing 7 and the scanning carriage 6 can be made low in height and the recording head unit 5 also can be designed compactly in size.

When the scanning carriage 6 and the housing 7 are fixed via the engaging member 42, the engaging member 42 has a resilient force to bring the ink inlets 21*a* to 21*d* into intimate contact with the ink outlets 19*a* to 19*d*. This can prevent ink leakage between the ink inlets 21*a* to 21*d* and the corresponding ink outlets 19*a* to 19*d*.

Even when the ink paths over which various colored inks separately flow for color printing are formed in the joint 9 and the container 24, the joint 9 and the container 24 can be designed compactly in size. In this invention, a sheet-feeding path may be provided in a vertical direction and the scanning carriage 6 may be opened upward so that the housing 7 can be detachable upward from the scanning carriage 6.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. An ink jet recording apparatus, comprising:

a scanning carriage that is movable in a direction perpendicular to a feeding direction of a recording medium;

a recording head with nozzles that is detachably mounted to the scanning carriage;

an ink supply source that is provided outside the scanning carriage and supplies ink to the recording head via a supply tube;

a joint member that is provided in the scanning carriage and connected to the supply tube of the ink supply source;

an ink inlet that is provided in the recording head;

an ink outlet that is provided in the joint member; and an engaging device that fixes the recording head to the scanning carriage, wherein the recording head is detachable from the scanning carriage in a direction perpendicular to a direction in which ink is ejected from the nozzles with respect to the recording medium, and the ink inlet is detachable from the ink outlet along the direction where the recording head is detachable from the scanning carriage.

2. The ink jet recording apparatus according to claim 1, wherein the recording head is detachable from the scanning carriage in a direction parallel to a surface of the recording head provided with the nozzles.

3. The ink jet recording apparatus according to claim 2, wherein the scanning carriage includes a pair of supporting members to guide and move the recording head close to the joint member in the direction parallel to the surface provided with the nozzles.

4. The ink jet recording apparatus according to claim 2, wherein the engaging device resiliently urges the ink inlet into intimate contact with the ink outlet.

5. The ink jet recording apparatus according to claim 2, wherein the nozzles of the recording head are arranged in a plurality of lines corresponding to colored inks, and the joint member includes ink flow paths corresponding to the colored inks therein.

6. The ink recording apparatus according to claim 2, wherein the ink inlet and the joint member are disposed on an opposite side of the surface provided with the nozzles, and the ink inlet and the ink outlet are connected to each other in substantially parallel with the surface provided with the nozzles.

7. The ink recording apparatus according to claim 2, further comprising:

a housing that includes the recording head and the ink inlet and integrally supports a supply path forming member that supplies ink to the recording head, wherein the housing is fixed to the scanning carriage via the engaging device and, when the scanning carriage and the housing are fixed, an end of the scanning carriage is supported by a guiding member that movably guides the scanning carriage, and an end of the housing, that is on a substantially opposite side of the end of the scanning carriage, is movably supported by another guiding member.

8. The ink jet recording apparatus according to claim 7, wherein the engaging device is disposed on the scanning carriage.

9. The ink jet recording apparatus according to claim 8, wherein the engaging device is formed of wire.

10. The ink jet recording apparatus according to claim 7, wherein the engaging device is disposed on the housing.

11. The ink jet recording apparatus according to claim 10, wherein the engaging device is formed of wire.

12. The ink jet recording apparatus according to claim 2, further comprising:

a flat cable that transmits a drive signal to the recording head from outside of the scanning carriage;

a control circuit board that is provided to the recording head; and a connector that is provided in the recording head and detachably connected to the flat cable when the scanning carriage and the recording head are connected.

13. An ink jet recording apparatus, comprising:

a scanning carriage that is movable in a direction perpendicular to a feeding direction of a recording medium;

a recording head with nozzles that is detachably mounted to the scanning carriage;

an ink supply source that is provided outside the scanning carriage and supplies ink to the recording head via a supply tube;

a flat cable that transmits a drive signal to the recording head from outside of the scanning carriage;

a joint member that is provided in the scanning carriage and connected to the supply tube of the ink supply source;

an ink inlet that is provided in the recording head;

an ink outlet that is provided to the joint member;

a control circuit board that is provided to the recording head; and a connector that is provided in the recording head and detachably connected to the flat cable when the scanning carriage and the recording head are connected.

14. The ink jet recording apparatus according to claim 13, wherein the control circuit board and the connector are disposed on an opposite side of a surface of the recording head provided with the nozzles, the recording head is detachable from the scanning carriage in the direction parallel to the surface provided with the nozzles with respect to the recording medium, and the ink inlet is detachable from the ink outlet along the direction where the recording head is detachable from the scanning carriage.

15. The ink jet recording apparatus according to claim 14, wherein the scanning carriage and the recording head are fixed via an engaging device so as to hermetically seal the ink inlet and the ink outlet parallel with the surface provided with the nozzles.

16. The ink jet recording apparatus according to claim 15 further comprising:

a housing that includes the recording head and the ink inlet and integrally supports a supply path forming member that supplies ink to the recording head, the connector provided with the housing, wherein the housing is fixed to the scanning carriage via the engaging device.

17. The ink jet recording apparatus according to claim 16, wherein, when the scanning carriage and the housing are fixed, an end of the scanning carriage is supported by a guiding member that movably guides the scanning carriage, and an end of the housing, that is on a substantially opposite side of the end of the scanning carriage, is movably supported by another guiding member.

18. The ink jet recording apparatus according to claim 17, wherein the engaging device is formed of wire and disposed on the scanning carriage.

19. The ink jet recording apparatus according to claim 17, wherein the engaging device is formed of wire and disposed on the housing.

20. The ink jet recording apparatus according to claim 13, wherein the nozzles of the recording head are arranged in a plurality of lines corresponding to colored inks, and the joint member includes ink flow paths corresponding to the colored inks therein.

* * * * *